US005785149A

United States Patent [19]

Luyts

[11] Patent Number: 5,785,149

[45] Date of Patent: Jul. 28, 1998

[54] SCREW-TYPE COMPRESSOR

[75] Inventor: Guido Jan Luyts, Ekeren, Belgium

[73] Assignee: Atlas Copco Airpower, Naamloze Vennootschan, Wilrijk, Belgium

[21] Appl. No.: 711,898

[22] Filed: Sep. 12, 1996

[30] Foreign Application Priority Data

Sep. 12, 1995 [BE] Belgium ..... 09500747

[51] Int. Cl.[6] ..... F01M 9/00

[52] U.S. Cl. ..... 184/6.12; 184/6.22; 184/6.24; 184/6.28; 418/85

[58] Field of Search ..... 184/6.12, 6.21, 184/6.22, 6.24, 6.28; 418/85

[56] References Cited

U.S. PATENT DOCUMENTS

| | | | |
|---|---|---|---|
| 2,515,153 | 7/1950 | Hornschurch | 184/6.28 |
| 3,223,197 | 12/1965 | Conover et al. | 184/6.28 |
| 4,356,889 | 11/1982 | Teeter | 184/6.12 |
| 4,780,061 | 10/1988 | Butterworth | 418/85 |
| 5,199,858 | 4/1993 | Tsuboi et al. . | |
| 5,566,781 | 10/1996 | Robert et al. | 194/1.5 |

FOREIGN PATENT DOCUMENTS

| | | |
|---|---|---|
| 0 587 157 | 3/1994 | European Pat. Off. . |
| 2 059 511 | 4/1981 | United Kingdom . |

*Primary Examiner*—Thomas E. Denion
*Attorney, Agent, or Firm*—Bacon & Thomas

[57] ABSTRACT

A screw-type compressor is described in which lubricants and cooling fluids are conducted principally through conduits maintained almost entirely within the gearcase and pressure housings of the compressor. In this arrangement according to the invention, the number of conduits, which are outside of the gearcase and pressure housings, between components and parts of the compressor is limited to a minimum.

7 Claims, 4 Drawing Sheets

SCREW-TYPE COMPRESSOR

BACKGROUND OF THE INVENTION

1. Field of the Invention

The present invention concerns a screw-type compressor containing a gearcase with at least one pressure stage; a lubricating device having as components at least a lubricant reservoir, a pump, a lubricant cooler, a filter and nozzles or distribution elements and which moreover has conduits for passing lubricant between these components; and a cooling arrangement having as components at least a compressed air cooler and the above-mentioned lubricant cooler, and which moreover has a number of conduits for cooling fluid between these components.

2. Discussion of Related Art

With the known screw-type compressors of this kind, the gearcase, the lubricating device and the cooling arrangement are set up individually and they are physically connected to one another by means of separate supports. Practically, they are connected to one another by means of a large number of conduits for lubricant and for cooling fluid.

These conduits consist of pipes and/or hoses and coupling elements and contain a large number of connections and sealings. These conduits must be sufficiently flexible or adjustable to absorb mutual differences in position of the components which are connected by such conduits.

Also, these known screw-type compressors require a large number of separate components, and mounting all these components is, partly because of the necessary adjustments, rather time-consuming. Moreover, the risk of leaks and large pressure drops is great with these known compressors.

SUMMARY OF THE INVENTION

The invention has for an objective a screw-type compressor whereby these and other disadvantages are excluded, and which as a consequence has a simple construction requiring only a minimum of adjustments, and further which contains a minimum number of connections and thus a low risk of leaks or large pressure drops.

This aim is reached according to the invention in that at least a number of components of the lubricating device and of the cooling arrangement are mounted directly on the gearcase or are integrated in the gearcase, and a number of the conduits between different components are integrated at least partially in the gearcase, such that the number of conduits between components or parts thereof situated outside the gearcase or the lubricating device and cooling arrangement is limited.

A number of functions such as the fixing, positioning and connecting of the components are integrated in the main components consisting of the gearcase, the lubricating device and the cooling arrangement. The sealing of mutual connections is provided by metal-metal contacts and by flexible rings.

Preferably, at least the compressed air cooler and the lubricant cooler of the cooling arrangement are mounted directly on the gearcase.

The supply line for cooling fluid which is connected to the lubricant cooler and the conduit for this cooling fluid which connects the lubricant cooler to the pressure stage can be at least partially integrated in the gearcase.

The conduits for lubricant between the pump and the lubricant cooler, between the lubricant cooler and the filter and between the filter and the nozzles or distribution elements can also be at least partially integrated in the gearcase.

BRIEF DESCRIPTION OF THE DRAWING FIGURES

In order to better explain the characteristics of the invention, the following preferred embodiment of a screw-type compressor according to the invention is illustrated, as an example only without being limitative in any way, with reference to the accompanying drawings, where:

FIG. 1 schematically represents the gearcase of a screw-type compressor according to the invention with the lubricating device only;

FIG. 2 schematically represents the gearcase of FIG. 1, but with the cooling arrangement only;

FIG. 3 shows a front view of a practical embodiment of the gearcase of the FIGS. 1 and 2, whereby components of the lubricating device and the cooling arrangement are represented as a chain line; and FIG. 4 shows a side view of the practical embodiment of the gearcase of FIG. 3, whereby components mounted thereupon are also represented as a chain line; and FIG. 5 shows a detail of the dowel pin installed between components associated with the compressor gear case.

DETAILED DESCRIPTION OF THE INVENTION

Figure 1:
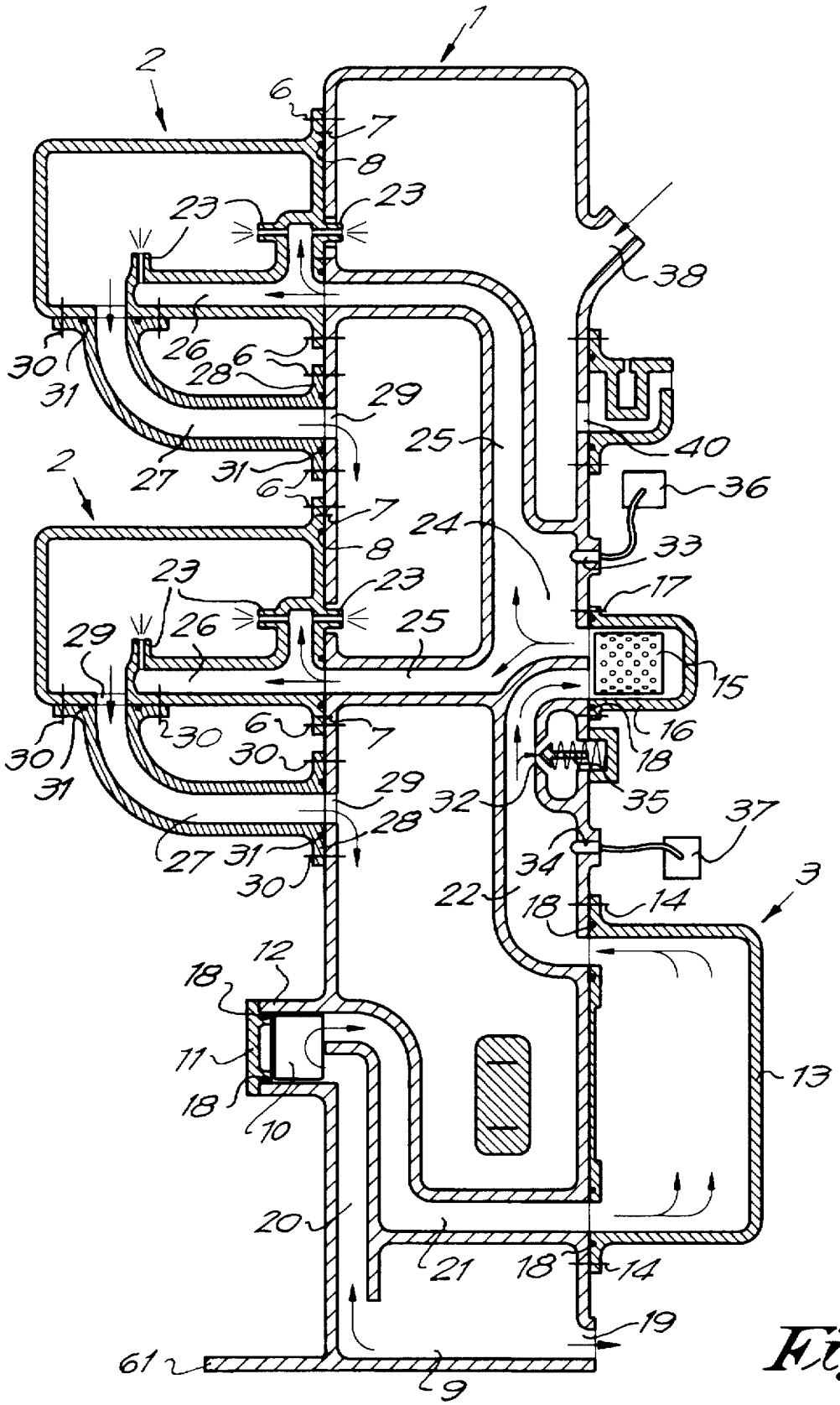
Figure 2:
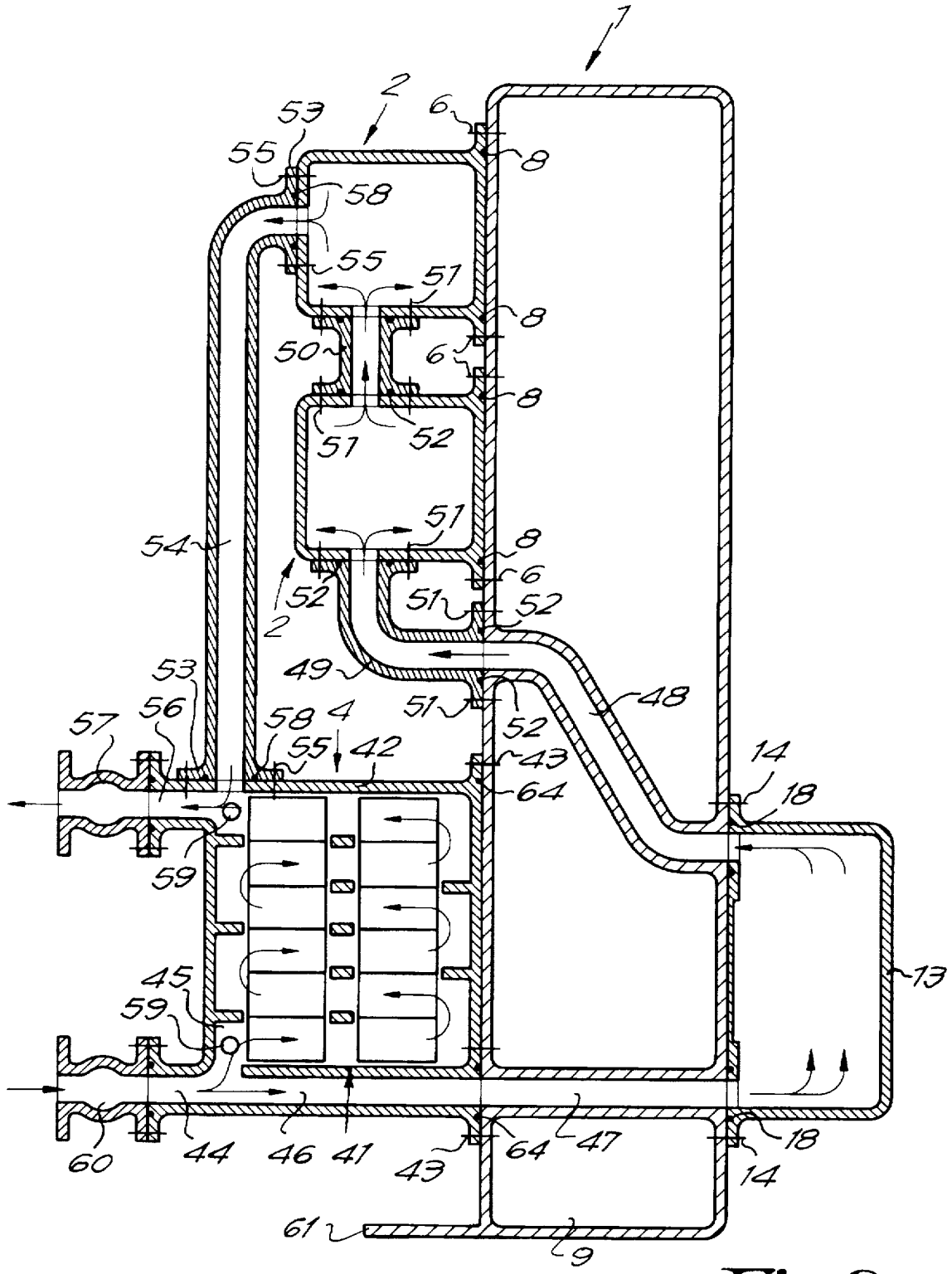

The screw-type compressor represented in the FIGS. 1 and 2 contains a gearcase 1 with one or more, for example two pressure stages 2, a lubricating device 3 with preferably oil as a lubricant and a cooling arrangement 4 with preferably water as a cooling fluid.

These main components 1 to 4 are fixed directly to one another and all the functions such as the fixing, positioning and connecting are mainly integrated in these main components, such that practically all connections outside these main components can be omitted, and no separate supports are required for the main components.

Figure 5:
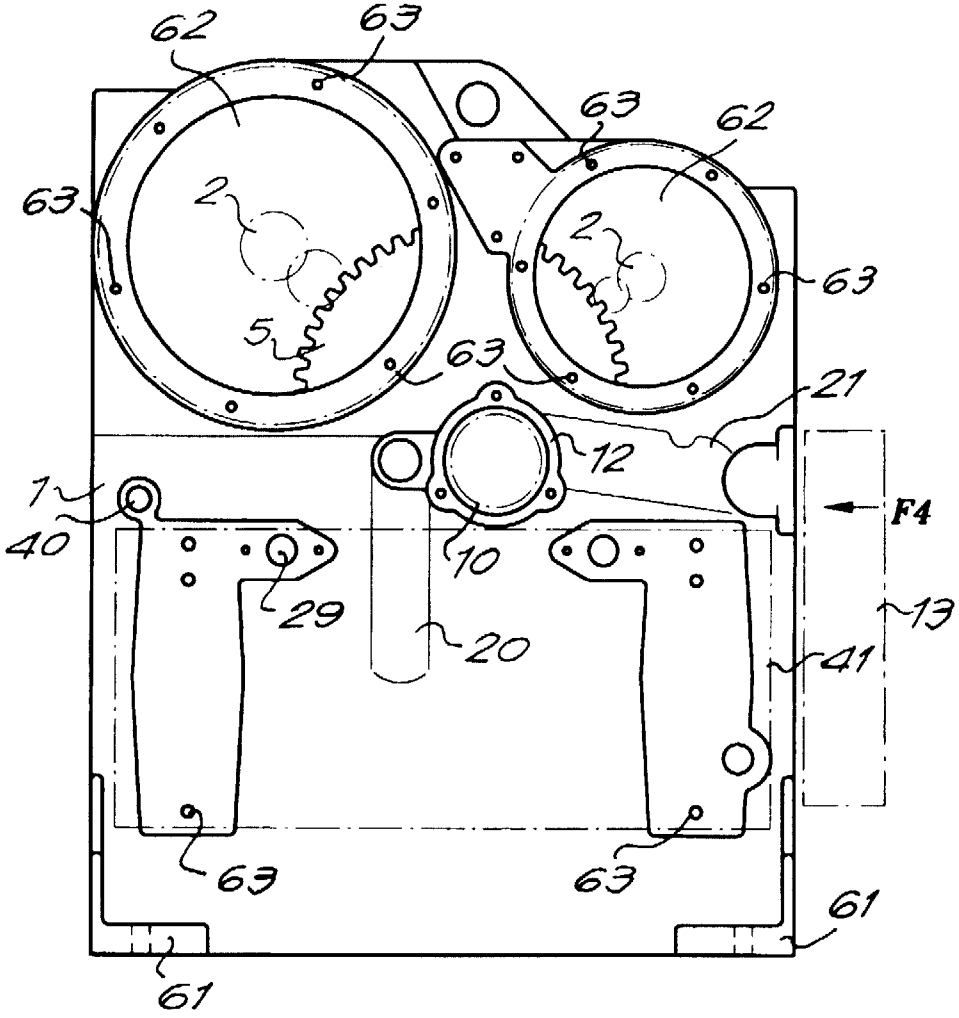
Figure 5:
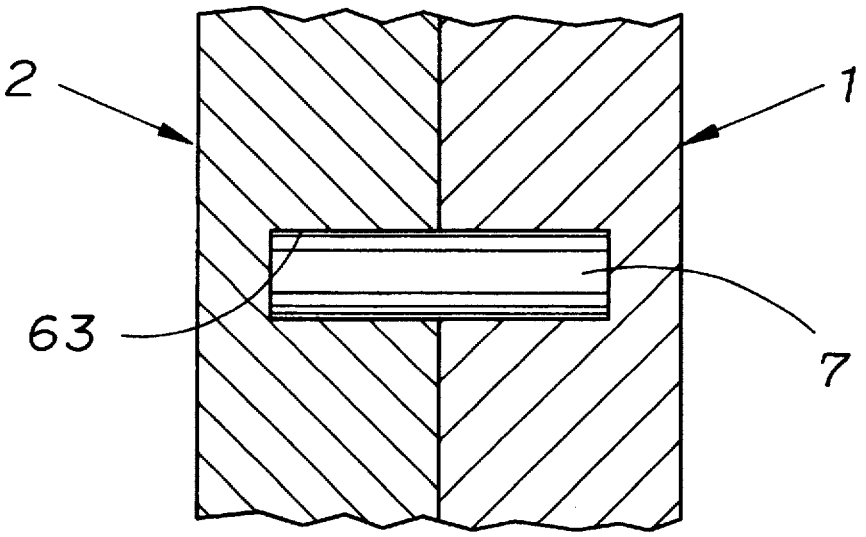

In the gearcase 1 is mounted a gear wheel transmission 5 (FIG. 3) in the usual manner driven by a motor which are not shown in the Figures for driving gear wheels of the pressure stages 2. These pressure stages 2 are fixed with their housings directly on the outside of the gearcase 1 by means of fastening means 6 such as bolts, and they are positioned with dowel pins 7, for example as shown in FIG. 5. A seal is obtained with a metal-metal contact between the housing and the gearcase 1 and through a flexible ring 8.

The gearcase 1 is provided with supports 61 at the bottom by which the entire compressor is supported.

As is schematically represented in FIG. 1, the lubricating device 3 contains a number of components which are mounted directly on the gearcase 1 or which are integrated in this gearcase.

Thus, the lubricating device 3 contains an oil reservoir 9 integrated with the bottom side of the gearcase 1, an oil pump 10 which is fixed in a part 12 of the gearcase 1 and sealed by means of a lid 11, an oil cooler 13 which is fixed directly on the outside of the gearcase 1 by fixing means 14, for example bolts, and an oil filter 15, whose housing 16 is also fixed directly on the outside of the gearcase 1 by fixing means 17, such as bolts or a threaded connection.

The seal between the lid 11 and the part 12, between the housing of the oil cooler 13 and the gearcase 1 and between the housing 16 of the oil filter 15 and the gearcase is formed by a metal-metal contact and a flexible sealing ring 18.

The oil reservoir 9 is equipped with a draining aperture 19.

The conduit 20 which connects the oil reservoir 9 to the oil pump 10, the conduit 21 between the oil pump 10 and the oil cooler 13 and the conduit 22 between the oil cooler 13 and the filter 15 are all entirely integrated in the gearcase 1 and are formed during the casting of the gearcase.

The filter 15 is connected by means of conduits 24-25-26 to nozzles or distribution elements 23 for lubrication of the bearings and the gear wheels of the two pressure stages 2 and for lubrication of the main bearings of the gear wheels in the gearcase 1. The conduits which lead to the pressure stages 2 consist of an internal common part 24 against the filter 15, an internal separate part 25 which, as well as the part 24, is integrated in the gearcase 1, and a part 26 which is integrated in the housing of the pressure stage 2 and which is connected to the part 25 through the fastening of the housing on the gearcase 1.

Only the return lines 27 for oil are external lines which are fixed on the housings of the a pressure stages 2, for example by means of flanges 28 at their ends, and on the outside of the gearcase 1 around an opening 29 by means of fixing structure 30. The sealing is provided for by means of flexible rings 31.

The gearcase 1 is further provided with openings or connections 32, 33 and 34 to which are connected an overflow or maximum pressure valve 35, an oil-pressure gauge 36 and an oil-temperature gauge 37 respectively.

Further, the gearcase 1 is provided with a filling opening 38, a fastening 39 for an oil-level gauge and a fastening 40 for de-aeration.

As represented in FIG. 2, the cooling arrangement contains the above-mentioned oil cooler 13 and a compressed air cooler 41 consisting of an intercooler and an after-cooler constructed in one casing 42 which casing 42 is fixed directly against the outside of the gearcase 1 by mechanism of fixing means 43. The positioning is carried out by means of dowel pins which are not shown in FIG. 2 and sealing by means of flexible rings 64.

A cooling-water intake 44 is formed in this casing 42 which intake 44 is connected to a supply 60 divided onto two parts inside the casing, namely a first branch or conduit 45 integrated in the compressed air cooler 41 for cooling the compressed air and a second branch or conduit 46–47 which opens into the oil cooler 13 and which contains a part 46 integrated in the compressed air cooler 41 and a part 47 extending through the gearcase 1 and being integrated in this gearcase.

The oil cooler 13 is connected to the pressure stages 2 by means of a conduit 48–49 for cooling water where a part 48 is integrated in the gearcase 1 and a connection 49 is connected onto it and fixed against the outside of the gearcase 1 and the outside of one of the pressure stages 2 respectively by means of flanges at the ends. Between the two pressure stages 2 is provided a connection 50 which is also fixed against the housings of the pressure stages 2 by means of flanges at the ends.

The fixing of the ends of the external connections 49 and 50 is realized by means of connecting structure 51, for example bolts, and a seal is ensured by means of flexible rings 52.

The reflow of the cooling fluid to a drain 57 occurs by way of external conduit 54 fixed by a fixing structure 55 through flanges 53 at the ends, to one of the pressure stages 2 and to the casing 42 of the compressed air cooler 41 respectively, on the side of the exit 56 thereof which is connected to the drain 57 for cooling fluid. The seal is provided by means of flexible rings 58.

The cooling arrangement is further provided with a filling and draining aperture and a de-aeration, whereas two connections 59 for chemical cleaning are provided on the casing 42 of the compressed air cooler 41.

As is shown by way of the arrows in FIG. 1, lubricating oil is pumped out of the reservoir 9 by the oil pump 10 and is pumped through the conduit 21 to the oil cooler 13, where it is cooled down by the cooling fluid. From there, the oil flows by the conduit 22 over the filter 15 and from there through the conduits 24-25-26 to the pressure stages 2.

The oil flows back to the reservoir 9 by the conduits 27.

As is represented by way of the arrows in FIG. 2, the cooling water is divided over the compressed air cooler 41 and the oil cooler 13, is reached through the conduit 46–47. From the oil cooler 13, the cooling water flows by the conduit 48–49 to the pressure stages and is returned by way of the conduit 54 to the output of the compressed air cooler 41.

Figure 4:
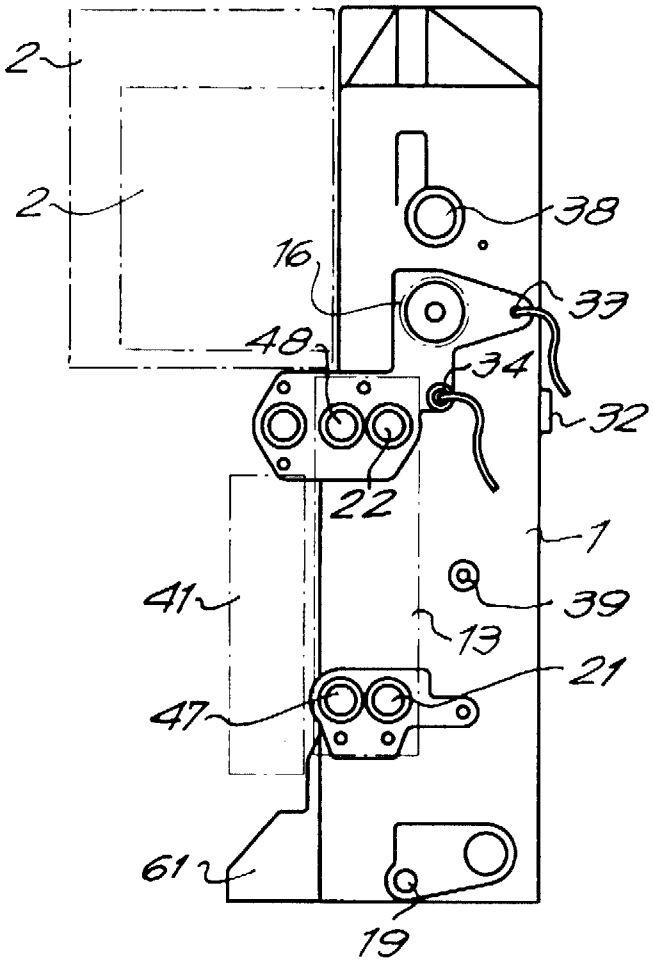

FIGS. 3 and 4 show how the screw-type compressor according to the above description and represented schematically in FIGS. 1 and 2 can be realized in practice. The gearcase 1 is drawn as a full line, and a number of the components of the lubricating device 3 and the cooling arrangement 4 mounted thereupon, as well as the pressure stages 2 are drawn as chain lines.

The gearcase 1 is provided with supports 61 at the bottom to support the entire compressor. Around the openings 62 for the connection of the pressure stages 2 and opposite the compressed air holder 41, holes 63 for the dowel pins used for positioning are visible.

The above-mentioned entire structure is compact, with a minimum of supports and connections. The mounting can be done very fast, with a minimum risk of leaks or large pressure drops.

The present invention is by no means limited to the above-described embodiment, represented in the accompanying drawings; but on the contrary, such a screw-type compressor can be made in all sorts of variants while still remaining within the scope of the invention.

What is claimed is:

1. A screw-type compressor of the type comprising the structure of a gearcase, at least one pressure stage, a lubricating mechanism and a cooling arrangement, wherein the lubricating mechanism includes a reservoir for maintaining lubricant, a pump for pumping said lubricant, a lubricant cooler for cooling said lubricant, a filter for filtering said lubricant, distribution nozzles for discharging said lubricant and lubricant conduits for conducting said lubricant between these structures of the lubricating mechanism, and wherein said cooling arrangement includes a fluid coolant mechanism for cooling said lubricant cooler, and interconnecting coolant conduits for passing cooling fluid between components of said lubricating mechanism and said cooling arrangement, said components of said lubricating mechanism and said cooling arrangement being both directly mounted on the exterior of and integrated within said gearcase, and portions of said lubricant and coolant conduits being integrated within said gearcase so that only portions of said lubricant and coolant conduits are disposed outside said gearcase, said lubricating mechanism or said cooling arrangement; and wherein at least said fluid coolant mechanism, said filter, said lubricant cooler, and portions of said nozzles are separately mounted directly on and externally of said gearcase within respective housings.

2. A screw-type compressor according to claim 1, wherein supply lines for conducting said cooling fluid to said lubricant cooler and those conduits for conducting said cooling fluid to said at least one pressure stage are at least partially integrated within said gearcase.

3. A screw-type compressor according to claim 1, wherein one portion of said lubricant conduits is disposed within said gearcase and extends between said pump and said lubricant cooler.

4. A screw-type compressor according to claim 1, wherein another portion of said lubricant conduits is disposed within said gearcase between said lubricant cooler and said filter housing.

5. A screw-type compressor according to claim 4, wherein a portion of said lubricant conduits is disposed between said filter housing and said distribution nozzles, said last recited portion being disposed at least partially within said gearcase.

6. A screw-type compressor according to claim 1, wherein said at least one pressure stage, said lubricant cooler and said fluid coolant mechanism are located in position on said gearcase by dowel pins spanning the connections between the said pressure stage, lubricant cooler, fluid coolant mechanism and the gearcase.

7. A screw-type compressor according to claim 1, wherein two connections for chemical cleaning are provided on said fluid cooling mechanism.

* * * * *